US011427877B2

(12) United States Patent
True et al.

(10) Patent No.: US 11,427,877 B2
(45) Date of Patent: Aug. 30, 2022

(54) DIRECT REDUCED IRON (DRI) HEAT TREATMENT, PRODUCTS FORMED THEREFROM, AND USE THEREOF

(71) Applicant: NUCOR CORPORATION, Charlotte, NC (US)

(72) Inventors: Bradford Granger True, Rock Hill, SC (US); David William Hendrickson, Hibbing, MN (US)

(73) Assignee: NUCOR CORPORATION, Charlotte, NC (US)

( * ) Notice: Subject to any disclaimer, the term of this patent is extended or adjusted under 35 U.S.C. 154(b) by 392 days.

(21) Appl. No.: 16/138,022

(22) Filed: Sep. 21, 2018

(65) Prior Publication Data

US 2019/0085420 A1 Mar. 21, 2019

Related U.S. Application Data

(60) Provisional application No. 62/561,433, filed on Sep. 21, 2017.

(51) Int. Cl.

| | |
|---|---|
| ***B22F 1/02*** | (2006.01) |
| ***C21B 13/00*** | (2006.01) |
| ***C22B 1/24*** | (2006.01) |
| *C21B 13/12* | (2006.01) |
| *C21B 13/14* | (2006.01) |

(52) U.S. Cl.

CPC ..... *C21B 13/0046* (2013.01); *C21B 13/0086* (2013.01); *C21B 13/0093* (2013.01); *C22B 1/2406* (2013.01); *C21B 13/12* (2013.01); *C21B 13/143* (2013.01)

(58) Field of Classification Search

None

See application file for complete search history.

(56) References Cited

U.S. PATENT DOCUMENTS

| | | | | |
|---|---|---|---|---|
| 3,953,196 | A * | 4/1976 | Obenchain | C21B 13/0046 75/10.15 |
| 4,692,353 | A | 9/1987 | Ahmed | |
| 4,806,154 | A | 2/1989 | Hauk | |
| 5,445,363 | A | 8/1995 | Becerra-Novoa et al. | |
| 5,746,805 | A | 5/1998 | Queneau et al. | |

(Continued)

FOREIGN PATENT DOCUMENTS

| | | | |
|---|---|---|---|
| JP | 01290701 | A * | 11/1989 |
| JP | 2004035955 | A * | 2/2004 |

(Continued)

*Primary Examiner* — Seth Dumbris

(74) *Attorney, Agent, or Firm* — Moore & Van Allen PLLC; Jeffrey R. Gray

(57) ABSTRACT

A DRI product and method of forming the DRI product. DRI is formed from a reducing process, and thereafter the DRI is subjected to another heat treatment that produces a DRI product. The DRI product formed has a metallic shell around at least a portion of a DRI core. The heat treatment may be delivered through the use of a plasma torch, a gas burner, an oven, or any other like heat source. The heat treatment may heat the DRI for a fraction of a second and quickly cool the DRI in order to melt the surface and form the metallic shell without vaporizing a significant portion of the DRI and without losing a significant amount of the latent energy in the DRI.

20 Claims, 6 Drawing Sheets

(56) References Cited

U.S. PATENT DOCUMENTS 6,036,744 A * 3/2000 Negami ..... C21B 13/105 75/503
6,395,052 B1 5/2002 Schrey et al.
6,395,056 B1 5/2002 Villarreal-Trevino et al.
6,478,841 B1 11/2002 Faccone et al.
6,517,605 B1 2/2003 Bates et al.
6,802,886 B2 10/2004 Hoffman et al.
7,678,176 B2 3/2010 Whitten et al.
7,828,873 B2 11/2010 Gurr
7,914,601 B2 3/2011 Farr et al.
7,976,610 B2 7/2011 Goodman
8,287,620 B2 10/2012 Millner et al.
8,419,825 B2 4/2013 Burgler et al.
8,632,622 B2 1/2014 Boehm et al.
8,771,397 B2 7/2014 Garza-Rodriguez et al.
9,169,535 B2 10/2015 Millner et al.
9,169,537 B2 10/2015 Kojo
9,238,253 B2 1/2016 Levanduski et al.
9,333,727 B2 5/2016 Bullard
9,365,906 B2 6/2016 Eder et al.
9,377,242 B2 6/2016 Millner et al.
9,400,139 B2 7/2016 Millner et al.
9,464,338 B2 10/2016 Hendrickson et al.
9,534,264 B2 1/2017 Millner et al.
2002/0002880 A1 1/2002 Pavlicevic et al.
2002/0011132 A1 1/2002 Pavlicevic et al.
2002/0178864 A1 6/2002 Watanabe
2013/0111809 A1* 5/2013 Kamikawa ..... C22B 1/245 44/603
2016/0340751 A1 11/2016 Saddik
2017/0058373 A1 3/2017 Motamedhashemi

FOREIGN PATENT DOCUMENTS

WO 9963119 A1 12/1999
WO 2009037587 A2 3/2009
WO WO-2013161653 A1 * 10/2013 ..... C21B 13/0093
WO 2016170467 A1 10/2016
WO 2017115133 A1 7/2017

* cited by examiner

DIRECT REDUCED IRON (DRI) HEAT TREATMENT, PRODUCTS FORMED THEREFROM, AND USE THEREOF

CROSS REFERENCE AND PRIORITY CLAIM UNDER 35 U.S.C. § 119

The present Application for a Patent claims priority to U.S. Provisional Patent Application Ser. No. 62/561,433 entitled "DIRECT REDUCED IRON (DRI) HEAT TREATMENT, PRODUCTS FORMED THEREFROM, AND USE THEREOF" filed on Sep. 21, 2017 and assigned to the assignees hereof and hereby expressly incorporated by reference herein.

FIELD

This application relates generally to the field of direct reduced iron (DRI), and more particularly DRI that is subjected to a heat treatment to form a DRI product for improved storage and transportation.

BACKGROUND

DRI, which has also been referred to in the past as sponge iron, is a commercial product that is comprised mostly of metallic iron, along with some FeO, gangue (e.g., non-ferrous materials contained in the iron ore used to produce DRI, such as silica, alumina, calcium oxide, magnesium oxide that surrounds or is mixed with iron ore), carbon, and/or other components in smaller amounts that may be present based on the reducing process of the iron ore. DRI may be formed by reducing iron ore using a reducing gas (e.g., mixtures of $H_2$, CO, CH4, or the like). DRI is particularly useful in Electric Arc Furnaces (EAFs) as a replacement for at least a portion of the metallic charge, which commonly includes scrap steel, because DRI has low levels of tramp elements harmful to steel quality, such as copper and chromium, DRI has a high percentage of metallic iron, and the carbon content in DRI produces chemical heat that helps reduce electricity usage required to melt the DRI. DRI may be produced in various forms, such as hot-briquetted iron (HBI), hot direct reduced iron (HDRI) (e.g., formed and directly sent to the EAF for use), DRI pellets, or other like DRI types.

BRIEF SUMMARY

Embodiments of the invention disclosed herein relate to processes for heat treating DRI after DRI formation in order to create DRI products; the DRI products having at least a partially metallic external surface formed from the processes; and the processes of using the DRI products. As will be disclosed in further detail herein, the present invention relates to heat treating DRI to form a DRI product with a metallic shell formed around at least a portion of the DRI. As such, the DRI product has a DRI core and a metallic surface that covers at least a portion of the DRI core. The heat treatment may be delivered through the use of a plasma torch, a gas burner, an oven, or any other conductive or radiant heat source. As will be described in further detail below, the heat treatment may heat the DRI for a fraction of a second and quickly cool the DRI in order to melt the surface and form a metallic shell on the external surface of the DRI without vaporizing a significant portion of the DRI and without losing a significant amount of the metallic iron or carbon content in the DRI. By forming the DRI product having a DRI core and an external metallic shell, the DRI product is stronger and the exposed surface area of the DRI in the DRI product is reduced. As a result, during storage and transport of the DRI product, it is less likely to fracture, the exposed surface area of DRI is reduced, and the amount of DRI fines cause by the DRI product rubbing together is reduced when compared to traditional types of DRI. As a result, the chances of the DRI reacting and melting is reduced because the surface area of the DRI that may potentially get wet and/or exposed to humid air is greatly reduced.

Embodiments of the invention comprise methods of forming DRI products, and products formed from the methods. The invention comprises heating DRI at a temperature for a time to melt at least a portion of the outer surface of the DRI, and wherein the heating results in the DRI product having a DRI core and a metallic outer shell formed around at least a portion of the DRI core.

In further accord with embodiments, the invention comprises direct reducing iron ore using a reducing gas or carbon source to form the DRI.

In other embodiments of the invention, the heating comprises passing the DRI through a heat source, wherein the temperature ranges between 440 degrees Fahrenheit to 20,000 degrees Fahrenheit.

In yet other embodiments of the invention, passing the DRI through the heat source comprises dropping the DRI through the use of gravity or providing a motive force.

In still other embodiments of the invention, the heating is performed through a plasma torch.

In further accord with embodiments of the invention, the heating is performed by passing the DRI through a gas burner, an oven, or any other conductive or radiant heat source.

In other embodiments of the invention, the time exposed to the temperature ranges from 0.05 to 5 seconds.

In yet other embodiments of the invention, the DRI is one or more DRI pellets.

In still other embodiments of the invention, the DRI product has a diameter ranging from 3 mm to 20 mm.

In further accord with embodiments, the invention further comprises pre-heating the DRI before performing the heating at the temperature for the time to melt at least the portion of the outer surface of the DRI.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Figure 1:
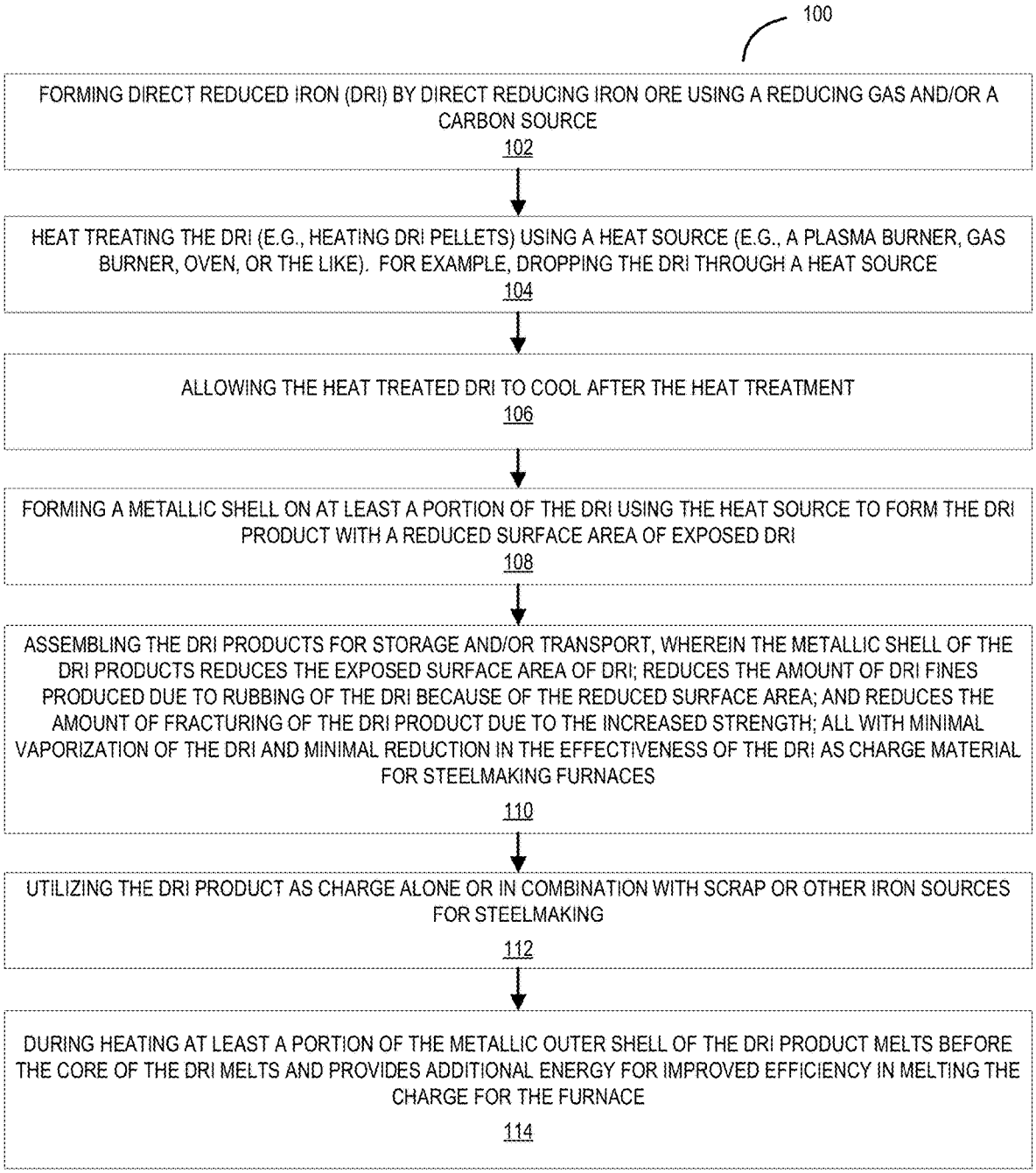
FIG. 1 illustrates a process flow for creating and using the DRI product of the present invention, in accordance with some embodiments of the present invention.

FIG. 1 illustrates a process 100 flow for forming the DRI product 250 disclosed herein, as well as utilizing the DRI product 250 disclosed herein. Specifically, block 102 of FIG. 1 illustrates that DRI 200 is formed using typical DRI processing steps. That is, iron ore is reduced using a reducing gas (e.g., mixtures of $H_2$, CO, CH4 or the like) and/or a carbon source (e.g., coal, or the like). While DRI is useful as charge material for an EAF (e.g., as a substitute for at least a portion of scrap steel, pig iron, or the like) due to its high iron content and carbon content, there are issues associated with utilizing DRI. In particular, when storing and/or transporting DRI, the DRI is susceptible to oxidation and rusting, especially when it becomes wet with water or subject to humidity in the air. In these cases when DRI oxidizes and/or rusts, it is more susceptible to igniting, and since DRI provides latent heat, when ignited it may cause the DRI to melt when it is stored and/or during transportation. Additionally, during handling, storage, and/or transportation the DRI (e.g., DRI pellets or other types) may rub together and/or facture into smaller pieces and produce DRI fines and/or DRI dust. The DRI fines are small particles of DRI produced by the rubbing and/or fracturing of the DRI, while the DRI dust are particle emissions smaller than the fines. The DRI fines and/or DRI dust (collectively "DRI particles") increase the surface area of the DRI, which increases the DRI that may be exposed to water or humid air, and thus, increases the risk of the DRI igniting and/or melting. Moreover, with respect to the DRI dust, it may present environmental issues (e.g., it may be breathed in), potential fire issues (e.g., it may accumulate on equipment and structures, and within buildings), and it is difficult and expensive to capture and/or clean (e.g., cleaning the equipment, structures, and buildings).

Figure 2:
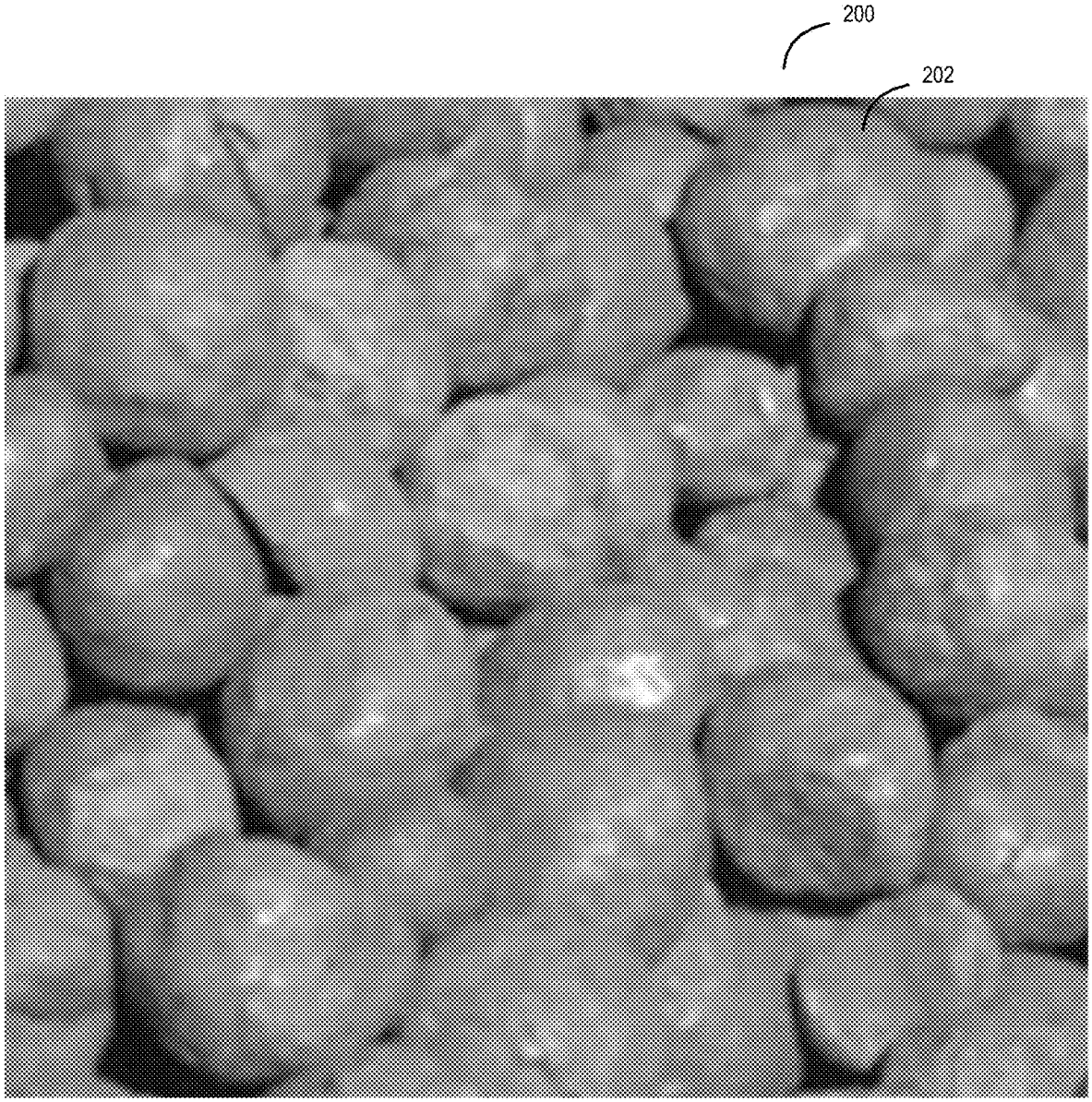
FIG. 2 illustrates DRI pellets before being subjected to a heat treatment, in accordance with some embodiments of the present invention.

In order to reduce the surface area of the DRI 200, as illustrated in block 104, the DRI is subjected to a heat treatment. The heat treatment is used to melt at least a portion of the outer surface 202 of the DRI 200. In one embodiment, as illustrated in FIG. 2, the DRI 200 is in the form of a pellet, and the DRI pellet is subjected to a quick heat treatment to melt at least a portion of the outer surface 202 of the DRI pellet. This melting process will also likely melt most, if not all, of any DRI dust that has accumulated on the outer surface 202 of the DRI 200.

The heat treatment may occur through the use of any heat source 300. However, in some embodiments of the invention, the heat treatment is provided through the use of a plasma torch. A plasma torch sends an arc through a gas, which results in the gas entering a fourth state of matter in which electrons wander around freely among the nuclei of atoms. The benefits of plasma torches are that the plasma torches allow for very high heat in localized areas. Moreover, plasma torches may operate on different types of gases including, nitrogen, helium, hydrogen, air, methane, propane, argon, oxygen, and/or the like. While the heat source 300 is generally described herein as being a plasma torch, it should be understood that any type of heat source (e.g., gas burner, oven, or any other conductive or radiant heat source) may be utilized that quickly heats the DRI 200 in order to create a DRI product 250 having an inner DRI core 252 and outer metallic shell 256 formed from melting the outer surface 202 of the DRI 200.

Figure 3:
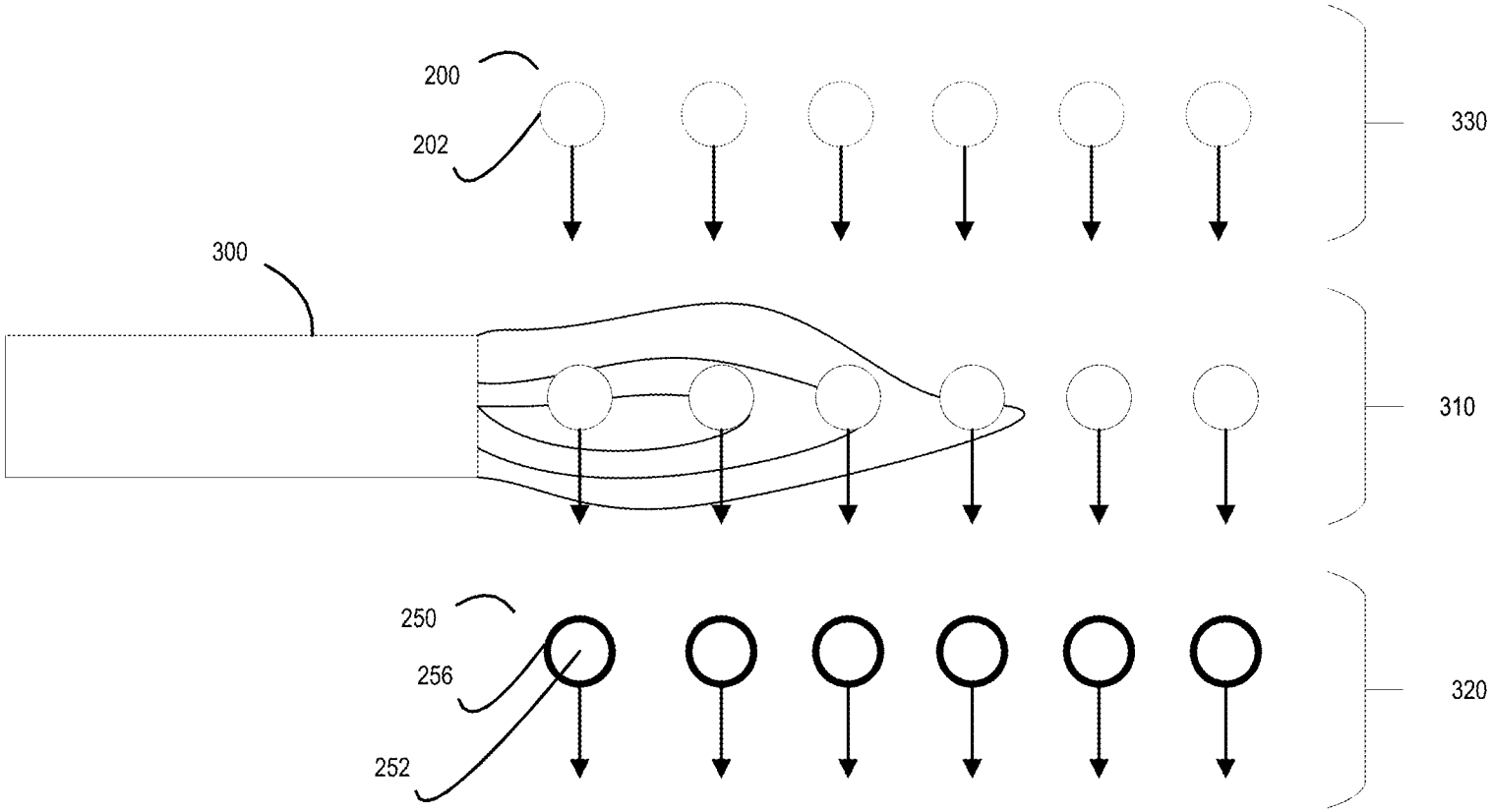
FIG. 3 illustrates a process of subjecting DRI product (e.g., DRI pellets) to a heat treatment using a heat source, in accordance with some embodiments of the present invention.
Figure 4:
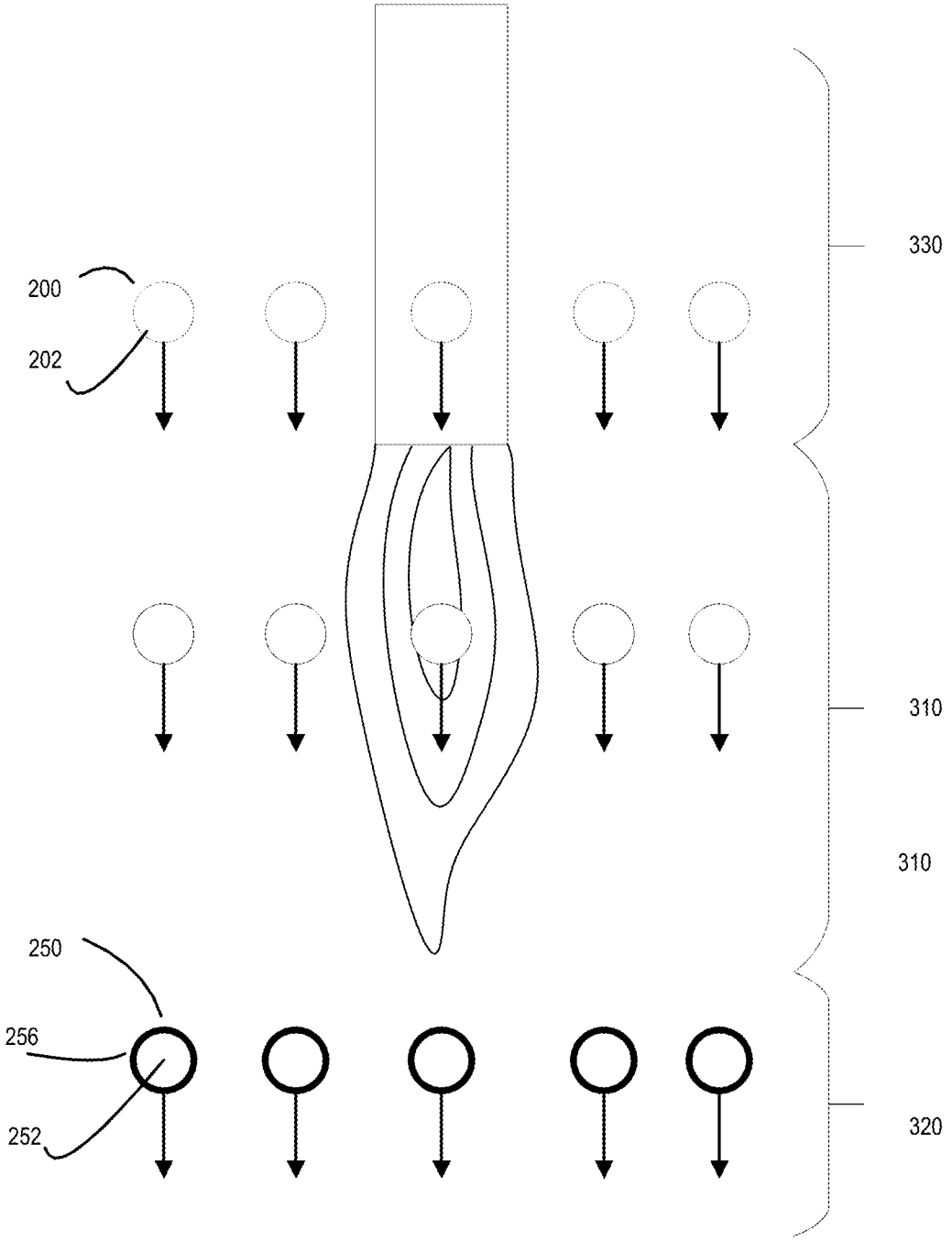
FIG. 4 illustrates a process of subjecting DRI product (e.g., DRI pellets) to a heat treatment using a heat source, in accordance with some embodiments of the present invention.

As illustrated in FIG. 3, in some embodiments of the invention, the DRI 200 may be dropped through a heating zone 310 of the heat source 300 (e.g., plasma torch, or other like torch) while one or more flames 302 of the heat source are located in a generally horizontal orientation (e.g., parallel with the ground, −45 to 45 degrees with the ground, or the like). Alternatively, as illustrated in FIG. 4, DRI may be dropped through a heating zone 310 of a heat source 300 (e.g., plasma torch, or other like torch) while one or more flames 302 of the heat source 300 are located in a generally vertical orientation (e.g., perpendicular, 45 to 135 degrees with respect to the ground). In other embodiments of the invention the DRI may be dropped through a heating zone that is oriented at any angle. In some embodiments of the invention, instead of utilizing gravity and/or along with using gravity, a motive force may be used to push and/or pull the DRI through the heating zone 310. That is, gas flow (e.g., air flow, or other gas flow) may be utilized to move DRI (e.g., DRI pellets) through a heating zone 310. In still other embodiments of the invention, DRI may be passed through a heating zone 310 using other means, such as but not limited to a conveyer, or other like movement means. As such, the movement means of the DRI through the heating zone(s) 310, or before (e.g., in pre-heating zones 330 described below, or the like) or after (e.g. in the cooling zone 320 described below, or the like) the heating zone(s) 310 may occur through the use of one, or any combination, of gravity, pneumatic, hydraulic, or mechanical devices.

The heating zone 310 may be one or more different temperature zones. In some embodiments a single heat zone 310 may provide the heat source, while in other embodiments multiple heating zones 310 may be utilized to heat treat the DRI 200. Each heating zone 310 may have a temperature gradient, or the combination of two or more heating zones 310 may create a temperature gradient. It should be understood that the one or more heating zones 310 may have a temperature gradient in one or more directions, for example, vertically and horizontally, as illustrated in FIGS. 3 and 4. That is, the temperature that the DRI is exposed to may be based on both the height of the heating zone 310 (e.g., vertically in FIGS. 3 and 4), and where the DRI 200 passes through the heating zone 310 (e.g., horizontally in FIGS. 3 and 4). In some embodiments, such as with respect to the plasma torch, the heat source 300 may be hotter near the exit of the heat source 300 when compared to another location of the heat source 300 (e.g., the end of the flame 302). Therefore, the location through which the DRI is passed in one or more heating zones 310 may also affect the thickness of the metallic shell 256 on the heat treated DRI product 250.

FIGS. 3 and 4 illustrate the heat source 300 as a single flame 302. However, it should be understood that multiple heat sources 300 (e.g., multiple flames 302, or the like) may be oriented on top of each other, next to each, in series, in parallel, circumferentially, radially, and/or the like in order to create the one or more heating zones 310 through which the DRI is passed (e.g., multiple heating zones may create a more uniform heating). Regardless of the configuration, the one or more heat zones 310 may have temperatures that may range from 440 degrees F. to 500, 1000, 1500, 2000, 2500, 3000, 3500, 4000, 4500, 5000, 5500, 6500, 7500, 8500, 10000, 12000, 14000, 17000, 20000, 25000, 30000, 35000, 40000, 45000, 50000, or other like degrees F. In some embodiments the temperature may range between, overlap, or fall outside of any of these temperature values. For example, these temperature values may vary by 1, 3, 5, 7, 10, 15, 20, 25, 30, 35, 40, 50, 60, 70, 80, or other like percentage. It should be understood that in order to reach some of these temperature values, a plasma torch may be used. It should also be understood that the temperatures in the heating zone may be uniform in some locations and/or may include a temperature gradient in some locations. As such, different temperature ranges may occur at different locations in the heating zone.

In some embodiments the heating time, which is the time the DRI 200 is exposed to one or more heating zones 310, is set in order to create the desired metallic shell of the DRI product 250 without vaporizing and/or melting a significant portion of the DRI 200. The exposure time may be a fraction of a second, such as for example, 0.01, 0.02, 0.03, 0.04, 0.05, 0.075, 0.1, 0.15, 0.2, 0.25, 0.3, 0.4, 0.5, 0.6, 0.7, 0.8, 0.9 seconds, or may be seconds, such as for example, 1, 2, 3, 4, 5 or the like seconds, or fall between any range of these values. In some embodiments the exposure time may range between, overlap, or fall outside of any of these time values. For example, these time values may vary by 1, 3, 5, 7, 10, 15, 20, 25, 30, 35, 40, 50, 60, 70, 80, 90, or other like percentage. The exposure time may be set by changing the angle at which the heat source 300 contacts the DRI (e.g., horizontal to vertical). The exposure time may also be set by widening or narrowing the temperature zone of the heat source (e.g., widening or narrowing the width of the heat source), such as changing the aperture through which a flame 302 exits a torch, adding additional flames 302, or the like. Additionally, the exposure time may be changed by speeding up or slowing down the DRI 200 passing through the heating zone 310, such as by providing a motive force in the direction of movement of the DRI and/or opposing the natural direction of movement of the DRI (e.g., opposing gravity, or the like).

It should be further understood that in some embodiments of the invention the DRI will be exposed to one or more pre-heating zones 330. The one or more pre-heating zones 330 may be the distance the DRI (e.g., DRI pellet) travels before it contacts the heat source 300 (e.g., the heating zone 310). While the DRI does not directly contact the heat source 300 in the pre-heating zone 330, the DRI may still be exposed to some residual heat from the heat source 300 or may be purposefully pre-heated by a pre-heating source. As such, the DRI may be pre-heated in this pre-heating zone 330. Consequently, the amount of time the DRI spends in the pre-heating zone (e.g., the height from which the DRI is dropped, or how fast the DRI is pushed or pulled through the pre-heating zone 330), and the temperature of the pre-heating zone 330 (e.g., caused by residual heat from the heating zone 310, or by a pre-heating source) also plays a role in heat treatment process (e.g., temperature and time spent in the heating zone 310) and the resulting DRI product 250. It should be understood that the temperature of the pre-heating zone 330 may be any of the temperatures, or ranges thereof, previously described, or a lower temperature value or range of values (e.g., down to room temperature in 5 degree increments). Moreover, the time in the pre-heating zone 330 may be any of the times, or ranges thereof, previously described with respect to the heating zone 310, or a higher time value or range of values (e.g., minutes or hours, such as up to 5 hours in minute increments).

It should be understood that the temperature to which the DRI 200 is heated is based on the temperature of the one or more heating zones 310 and/or the one or more pre-heating zones 330, the exposure time of DRI 200 to the one or more heating zones 310 and/or the one or more pre-heating zones 330, the location within the one or more heating zones 310 through which the DRI 200 passes (where the DRI passes in the temperature gradient), and the size of the DRI (e.g., may take higher temperatures to melt larger sizes of DRI 200). As such, it should be understood that the temperatures that the DRI 200 may reach from the heat source may range from 70 degrees F. to 250, 450, 900, 1350, 1800, 2300, 2800, 3300, 4000, 4900, 5800, 6700, 7600, 8500, 9500, 10500, 12000, 14000, 16000, 18000, 20000, 22000, or other like degrees F. In some embodiments the temperature of the DRI 200 may range between, overlap, or fall outside of any of these numbers. For example, these temperature values may vary by 1, 3, 5, 7, 10, 15, 20, 25, 30, 35, 40, 50, 60, 70, 80, or other like percentage.

As the DRI 200 is exposed to the heat source 300, a portion of the outer surface 202 of the DRI 200 will melt. In some embodiments, which will be described in further detail later the smaller DRI 200 (e.g., DRI fines, smaller DRI pellets, or the like) my completely melt and adhere to the melted or unmelted portions of the larger DRI sizes (e.g., the larger DRI pellets). The portion of the DRI 200 that is melted will likely remain attached to the unmelted portion of the DRI 200 through surface tension. As illustrated by block 106 of FIG. 1, after exiting the one or more heating zone 310, the melted portion of the DRI 200 will be allowed to cool. The melted portion of the DRI 200 will begin to cool and solidify in a cooling zone 320 located after the heating zone 310. In some embodiments of the invention the cooling zone 320 may be an area in which the DRI is allowed to cool naturally after being heated (e.g., based on the temperature of the air). For example, in some embodiments, the cooling zone 320 may simply be a distance that the DRI 200 is allowed to fall by gravity until the melted portion of the DRI 200 is able to solidify. However, in some embodiments the cooing zone 320 may include a cooler, such as forced air, water cooling, cooling of the apparatus through which the DRI 200 is passing, or the like. The desired amount of cooling may be determined by adjusting the time that the DRI product passes (e.g., falls, is pushed or pulled, or the like) through a cooling zone 320 and/or controlling the temperature of the cooling zone 320. For example, extending the amount of time the DRI falls after passing through the heating zone and/or adjusting a temperature of a cooled portion of the cooling zone 320 will affect the time it takes to cool the DRI product.

It should be understood that the pre-heating zone 330, the heating zone 310, and the cooling zone 320, and/or the components thereof (e.g., one or more pre-heating sources, one or more heat sources, and/or one or more coolers) may be contained within one or more housings (e.g., a single housing or different combinations of multiple housings) in order to perform the process described herein.

Figure 5:
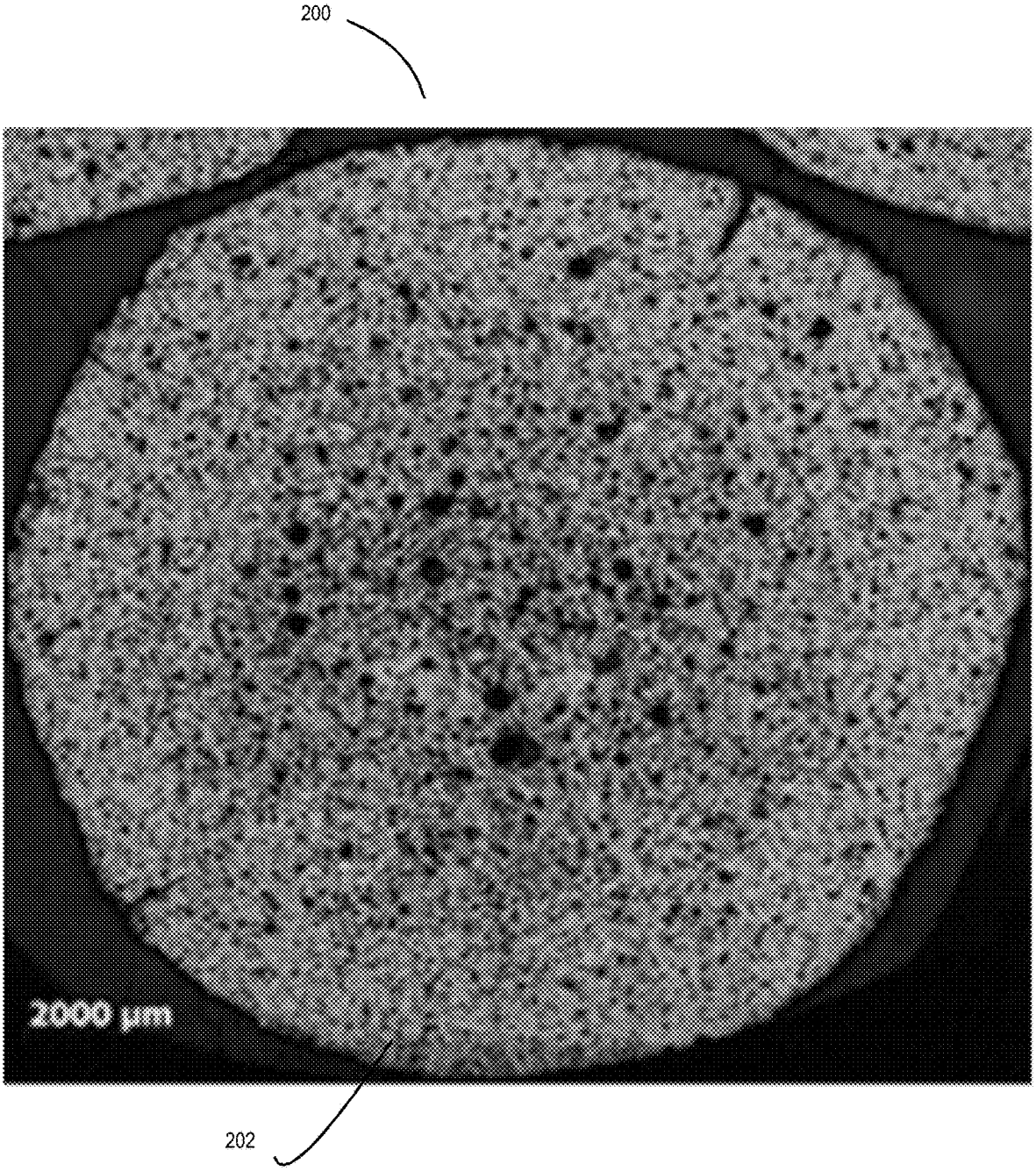
FIG. 5 illustrates a cross-sectional view of a DRI pellet before being subjected to a heat treatment, in accordance with some embodiments of the present invention.
Figure 6:
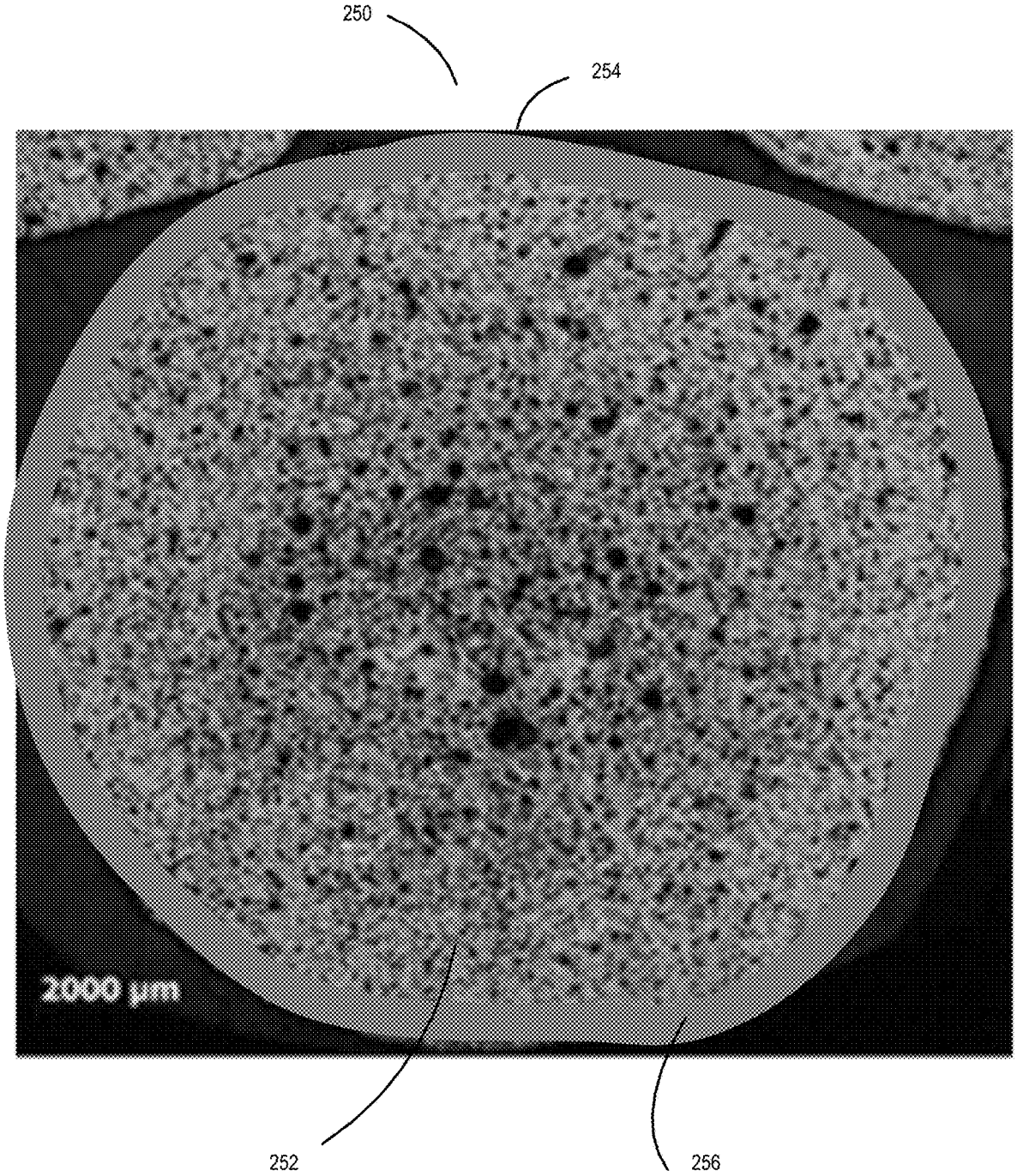
FIG. 6 illustrates a cross-sectional view of a DRI pellet after being subjected to a heat treatment, in accordance with some embodiments of the present invention.

As illustrated in block 108 of FIG. 1, after the heat treatment (e.g., heat source and/or pre-heating source) and cooling is completed, at least a portion of the DRI 200 (and in some cases the entire outer surface of the DRI) has a metallic outer shell 256. The resulting DRI product 250 includes an internal DRI core 252 made of DRI and an outer metallic shell 256 (over at least a portion of the DRI product). FIG. 5 illustrates a cross section of one type of DRI (e.g., DRI pellet). As illustrated in FIG. 5, the DRI 200 has a spongy like appearance, including interior voids, surface voids, or the like that increase the surface area of the DRI 200 that may become exposed to elements (e.g., water, air, or the like). Alternatively, FIG. 6 illustrates cross-sectional view of one type of DRI product 250 (e.g., DRI pellet) in accordance with embodiments of the present disclosure, in which a metallic shell 256 has formed around the outer surface 254 of the DRI product 250. It should be understood that depending on the heat treatment process, the metallic shell 256 may be formed around the entire external surface 254 of the DRI core 252, or it may only extend around a portion of the external surface 254 of the DRI core 252.

Regardless of the percentage of the DRI core 252 that is covered in the metallic shell 256, the amount of DRI that is exposed in the DRI product 250 is less than typical DRI forms. Due to the reduced surface area of the DRI, the DRI products 250 will have less surface area to rub against each other, thus resulting in the reduction of DRI fines and/or DRI dust that may be produced when the DRI is handled, stored, and/or transported. Moreover, due to the reduced surface area of the DRI, the DRI products 250 will have less surface area exposed to the elements, which reduces the chances that the DRI may ignite or otherwise melt. While there are advantages to creating the metallic shell 256, a potential disadvantage may be that a portion of the DRI 200 is transformed from DRI 200 to the metallic shell 256, which reduces a least a portion of the latent heat energy of the DRI 200 when used in the furnace. By reducing the latent heat energy in the DRI, the energy is no longer available to help melt other DRI, scrap steel, or iron ore in a furnace (e.g., EAF, or the like) during the steelmaking process.

It should be understood that the parameters of the process may be utilized in order to control the thickness of the metallic outer shell 256 of the DRI product 250. It should be further understood, that it may be beneficial to create a metallic shell 256 of a particular thickness in order to achieve the desired benefits (e.g., reduces the DRI product from breaking apart, reduces rubbing of the DRI to reduce DRI fines and/or DRI dust, reduce the surface area of DRI exposed to the elements, or the like), but also to reduce the amount of DRI that is transformed into to a metal in order to reduce the disadvantage of losing some of the latent heat energy of the DRI 200. As such, in some embodiments it may be beneficial to reduce the volume of the DRI that is melted to the smallest value while still providing a metallic shell 256 around at least a portion of the external surface 254 of the DRI product 250. For example, the percent volume of the DRI 200 that is melted (e.g., turned into the metallic shell 250) may be 1, 2, 3, 4, 5, 6, 7, 8, 9, 10, 12, 14, 16, 18, 20, 22, 24, 26, 28, 30, 32, 34, 36, 38, 40, 45, 50, 55, 60, 65, 70, 75, 80, 85, 90, 100, or the like percentage or range between any of these percentages. However, it should be understood that the percent volume melted may range between, overlap, or fall outside of any of these numbers. In some embodiments it may be beneficial to cover a particular percentage of the surface area of the external surface 254 of the DRI product 250. For example, the metallic shell 250 may cover at least a specific percentage of the external surface 254 of the DRI. For example, the percentage of coverage may be 5, 10, 20, 30, 40, 50, 55, 60, 65, 70, 75, 80, 85, 90, 95, 100, or other like percentage or range between any of these percentages. However, it should be understood that the percent coverage may range between, overlap, or fall outside of any of these percentages. In some embodiments, these percentage values may vary by +/−1, 2, 3, 4, 5, 6, 7, 8, 9, 10, or other like percentage.

As previously described, any type of DRI 200 may be utilized in the present invention, such as but not limited to DRI pellets. In some embodiments the DRI pellets (or other DRI type) may have a diameter that is 2.5, 3, 3.5, 4.5, 5, 5.5, 6, 6.5, 7, 7.5, 8, 8.5, 9, 9.5 10, 10.5, 11, 11.5, 12, 12.5, 13, 13.5, 14, 14.5, 15, 16, 17, 18, 19, 20, 25, 30, 35, 40, 50, 60, 70, 80, 90, 100 mm, or the like. However, it should be understood that the size of the DRI pellets may range between, overlap, or fall outside of any of these numbers. In other embodiments of the invention, other DRI types may be any size. For example, these diameter values may vary by 1, 3, 5, 7, 10, 15, 20, 25, 30, 35, 40, 50, 60, 70, 80, 90, or other like percentage. Regardless of the size of the DRI product 250, the parameters of the process may be adjusted in order to create the desired metallic shell 256 on the surface 254 of the DRI product 250.

It should be understood that when the DRI is less than about 6 mm, it is typically referred to as DRI fines. In typical processing DRI that is less than 6 mm (or less than another similar size, such as less than 8, 7, 5, or 4 mm, or the like) is screened out before the remaining DRI is shipped, stored, and/or used. The DRI that is less than 6 mm undergoes additional processing, such as cold briquetting (e.g., heated below 650 degrees C., and optionally using a binder), in order to form the DRI fines into a larger DRI briquettes (e.g., cold briquetted iron (CBI)). This additional processing increases the costs associated with using DRI. Moreover, the resulting CBI still has the same undesirable characteristics at the original DRI, that is, a large surface area, potential fracturing, and rubbing that may create additional DRI fines and/or DRI dust. Therefore, as briefly discussed above, for the smaller sizes of DRI, such as when the DRI is less than about 6 mm (e.g., DRI fines), the DRI may be completely melted during the heat treatment process, and may adhere to the larger sized DRI (e.g., DRI larger than 6 mm). After the heat treatment, any of the smaller sized DRI product 250 that remains (e.g., less than 6 mm) may be shipped along with the larger sized DRI product (e.g., greater than 6 mm), or the smaller sized DRI product 250 may be separated from the larger sized DRI product 250. In this way, the DRI fines do not have to be separated from the larger DRI types before heat treatment and do not require additional processing into other DRI forms (e.g., CBI, or the like). As such, the processing costs associated with separating the DRI fines and forming other DRI types is eliminated or reduced.

It should be further understood, that different sized DRI 200 may require a different heat treatment to achieve the desired results. As such, embodiments of the invention may include separating the DRI 200 into different sizes using a sorting system. Once separated the different sizes of DRI 200 may be sent to different heat treatment processes that have different parameters (e.g., heating temperatures, different exposure times, or the like), in order to achieve the desired DRI product 250 (e.g., same volume converted to a metallic shell, same thickness of the shell, or the like) regardless of the initial size of the DRI 200.

Returning to FIG. 1, block 110 illustrates that after the DRI product 250 is subjected to the heat treatment and cooled, such that the metallic shell 256 is formed, the DRI product 250 may be assembled together for storage (e.g., local storage, storage for transport, or the like) and/or transport (e.g., rail, truck, ship, and/or other like transport) for shipment to storage for future use in a furnace. Due to the presence of a metallic shell 256 around at least a portion of the DRI core 252, when the DRI product 250 rubs together during storage and/or transport the metallic shells 256 reduce the surface area of the exposed DRI and thus reduce the amount of DRI fines and/or DRI dust created by the rubbing. It should be understood that in some cases the DRI product 250 (e.g., DRI pellets) may still break apart and/or may have an outer surface with exposed DRI that is not covered by the metallic shell 256. As such, the metallic shells 256 and/or exposed DRI surfaces may rub against other exposed DRI and create DRI fines and/or DRI dust that increase the total surface area of the exposed DRI. However, it should also be understood that the process described herein will greatly reduce the amount of exposed DRI and the amount of DRI fines and/or DRI dust that would have been exposed without the heat treatment process that resulted in the metallic shell 256. For example, the total surface area of exposed DRI being stored may be reduced by 25, 50, 75, 100, 125, 150, 175, 200, 250, 300, 350, 400, 450, 500, 600, 700, 800, 900, 1000 percent, or the like. However, it should be understood that the reduction of the exposed surface area of the DRI 200 may range between, overlap, or fall outside of any of these percentages. In some embodiments, these percentage values may vary by +/−5, 10, 15, 20, 25, 30, 35, 40, 45, 50, or other like percentage Block 112 in FIG. 1, further illustrates that when needed, the DRI product 250 is utilized as charge for a furnace, for example, in an EAF charge. As previously discussed, the DRI product 250 may be utilized by itself, but more likely along with scrap steel and/or other iron ore. As previously discussed, the DRI improves the quality of the steel charge, as well as improves the efficiency of the furnace because the DRI product 250 gives off heat as it melts (e.g., as the DRI core 252 melts).

FIG. 1 further illustrates in block 114 that during heating of the scrap in the furnace, such as through the use of electrodes, gas burners, and/or the like, the metallic shell 256 of the DRI product 250, any exposed DRI, scrap steel, and/or other charge will begin to melt. As such, as the metallic shell 256 melts and exposes the DRI core 252, the DRI core 252 ignites and energy is given off which contributes to melting other DRI product 250, the scrap steel, and/or other charge. This reduces the amount of energy that is needed through the use of the electrodes, burners, or other energy sources, to melt the charge. As such, the DRI product 250 improves the efficiency of the furnace.

It will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Certain terminology is used herein for convenience only and is not to be taken as a limiting, unless such terminology is specifically described herein for specific embodiments. For example, words such as "horizontal", "vertical", "ground", "top", "next to", "in series", "parallel", "circumferentially", "radially", or the like may merely describe the configurations shown in the Figures and described herein for some embodiments of the invention. Indeed, the components may be oriented in any direction and the terminology, therefore, should be understood as encompassing such variations unless specified otherwise. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A method of forming a direct reduced iron (DRI) product, comprising:

providing a heat treatment to at least a portion of an outer surface of DRI at a temperature and for a time to melt at least the portion of the outer surface of the DRI, wherein the DRI was formed from direct reducing iron ore, and wherein the heat treatment results in the DRI product having a DRI core with a plurality of voids and a metallic outer shell formed around at least the portion of the DRI core, wherein the metallic outer shell is non-porous and covers at least a portion of the plurality of voids of the DRI core.

2. The method of claim 1, further comprising:

direct reducing the iron ore using a reducing gas or a carbon source to form the DRI.

3. The method of claim 1, wherein the heat treatment comprises passing the DRI through a heat source, wherein the temperature of the heat treatment ranges between 440 degrees Fahrenheit to 20,000 degrees Fahrenheit.

4. The method of claim 3, wherein passing the DRI through the heat source comprises dropping the DRI and using gravity or providing a motive force.

5. The method of claim 1, wherein the metallic outer shell reduces an exposed surface area of the DRI core, and wherein breaking of the DRI product and rubbing of the DRI core with adjacent DRI products is reduced.

6. The method of claim 1, wherein the heat treatment is performed by passing the DRI through a plasma torch, a gas burner, an oven, or any other conductive or radiant heat source.

7. The method of claim 1, wherein the time exposed to the temperature ranges from 0.05 to 5 seconds.

8. The method of claim 1, wherein the DRI is one or more DRI pellets.

9. The method of claim 1, wherein the DRI product has a diameter ranging from 3 mm to 20 mm.

10. The method of claim 1, further comprising:

pre-heating the DRI before performing the heat treatment at the temperature for the time to melt at least the portion of the outer surface of the DRI.

11. A direct reduced iron (DRI) product, comprising:

a DRI core with a plurality of voids; and a metallic outer shell formed around at least a portion of the DRI core, wherein the metallic outer shell is non-porous and covers at least a portion of the plurality of voids of the DRI core;

wherein the metallic outer shell is formed around the DRI core by a heat treatment of at least a portion of an outer surface of DRI at a temperature and for a time to melt at least the portion of the outer surface of the DRI without melting the DRI core, and wherein the DRI was formed from direct reducing iron ore.

12. The DRI product of claim 11, wherein the heat treatment comprises passing the DRI through a heat source, wherein the temperature of the heat treatment ranges between 440 degrees Fahrenheit to 50,000 degrees Fahrenheit.

13. The DRI product of claim 11, wherein the DRI formed by the direct reducing of the iron ore comprises using a reducing gas or a carbon source to form the DRI.

14. The DRI product of claim 12, wherein the temperature of the heat treatment ranges between 440 degrees Fahrenheit to 20,000 degrees Fahrenheit.

15. The DRI product of claim 12, wherein the passing the DRI through the heat source comprises dropping the DRI and using gravity or by providing a motive force.

16. The DRI product of claim 11, wherein the metallic outer shell reduces an exposed surface area of the DRI core, and wherein breaking of the DRI product and rubbing of the DRI core with adjacent DRI products is reduced.

17. The DRI product of claim 11, wherein the heat treatment is performed by passing the DRI through a plasma torch, a gas burner, an oven, or any other conductive or radiant heat source.

18. The DRI product of claim 11, wherein the time exposed to the temperature ranges from 0.05 to 5 seconds.

19. The DRI product of claim 11, wherein the DRI is one or more DRI pellets.

20. The DRI product of claim 11, wherein the DRI product has a diameter ranging from 3 mm to 20 mm.

* * * * *